US007824534B2

(12) United States Patent
Tsuchida et al.

(10) Patent No.: US 7,824,534 B2
(45) Date of Patent: Nov. 2, 2010

(54) COPPER ELECTROLYTIC SOLUTION CONTAINING AS ADDITIVE COMPOUND HAVING SPECIFIC SKELETON, AND ELECTROLYTIC COPPER FOIL MANUFACTURED THEREWITH

(75) Inventors: Katsuyuki Tsuchida, Kitaibaraki (JP); Hironori Kobayashi, Kitaibaraki (JP); Masashi Kumagai, Kitaibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 1122 days.

(21) Appl. No.: 10/588,686

(22) PCT Filed: Dec. 9, 2005

(86) PCT No.: PCT/JP2005/022662

§ 371 (c)(1),
(2), (4) Date: Aug. 7, 2006

(87) PCT Pub. No.: WO2006/080148

PCT Pub. Date: Aug. 3, 2006

(65) Prior Publication Data

US 2007/0170069 A1 Jul. 26, 2007

(30) Foreign Application Priority Data

Jan. 25, 2005 (JP) ..... 2005-016760

(51) Int. Cl.
*C25D 3/38* (2006.01)

(52) U.S. Cl. ..... 205/296; 205/297; 205/298

(58) Field of Classification Search ..... 205/296, 205/297, 298

See application file for complete search history.

(56) References Cited

U.S. PATENT DOCUMENTS 3,264,216 A * 8/1966 Rockett ..... 508/304

(Continued)

FOREIGN PATENT DOCUMENTS

JP 63-310989 12/1988

(Continued)

OTHER PUBLICATIONS

Sawyer et al., "Interaction of Anionic Detergents and Certain Polar Aliphatic Compounds in Foams and Micelles", J. Phys. Chem. (no month, 1958), vol. 62, No. 2, pp. 159-166.*

(Continued)

*Primary Examiner*—Edna Wong
(74) *Attorney, Agent, or Firm*—Flynn, Thiel, Boutell & Tanis, P.C.

(57) ABSTRACT

The object of the present invention is to obtain a low profile electrolytic copper foil with a low surface roughness at the rough surface side (opposite side from the glossy side) in the electrolytic copper foil manufacture using a cathode drum and, particularly, to obtain an electrolytic copper foil with excellent elongation and tensile strength that permits fine patterning. Another object is to obtain a copper electrolytic solution that allows uniform copper plating without pinholes on a 2-layer flexible substrate. This copper electrolytic solution contains, as an additive, a compound having the specific skeleton represented by General Formula (1) below which is obtained by an addition reaction in which water is added to a compound having in a molecule one or more epoxy groups:

(1)

wherein A is an epoxy compound residue and n is an integer of 1 or more.

3 Claims, 3 Drawing Sheets

U.S. PATENT DOCUMENTS

| | | | | |
|---|---|---|---|---|
| 4,376,685 | A * | 3/1983 | Watson | 205/298 |
| 2004/0149583 | A1 | 8/2004 | Kumagai et al. | |
| 2006/0166032 | A1 | 7/2006 | Kumagai et al. | |

FOREIGN PATENT DOCUMENTS

| | | | |
|---|---|---|---|
| JP | 08-156176 | | 6/1996 |
| JP | 10-193505 | | 7/1998 |
| JP | 10-330983 | | 12/1998 |
| JP | 2000-261113 | | 9/2000 |
| JP | 2002-506927 | | 3/2002 |
| JP | 2002-508452 | | 3/2002 |
| JP | 2002-322586 | A | 11/2002 |
| JP | 2004-107786 | | 4/2004 |
| JP | 2004-137588 | | 5/2004 |
| JP | 2004-315945 | | 11/2004 |
| WO | WO 98/08361 | | 2/1998 |
| WO | WO 98/59095 | | 12/1998 |
| WO | WO 2004/055246 | | 7/2004 |

OTHER PUBLICATIONS

De Almeida et al., "Voltammetric and Morphological Characterization of Copper Electrodeposition from Non-Cyanide Electrolyte", J. of Appl. Electrochem. (no month, 2002), vol. 32, pp. 763-773.*

Japanese language Office Action in a counterpart foreign application dated Jul. 6, 2009 (4 sheets).

Japanese language Office Action in a counterpart foreign application dated May 8, 2009 (4 sheets).

Japanese language Office Action in a counterpart foreign application dated Apr. 9, 2009 (3 sheets).

"Voltammetric and morphological characterization of copper electrodeposition from non-cyanide electrolyte", M.R.H. De Almeida, et al., Journal of Applied Electrochemistry, vol. 32, pp. 763-773 (2002).

* cited by examiner

COPPER ELECTROLYTIC SOLUTION CONTAINING AS ADDITIVE COMPOUND HAVING SPECIFIC SKELETON, AND ELECTROLYTIC COPPER FOIL MANUFACTURED THEREWITH

TECHNICAL FIELD

The present invention relates to a copper electrolytic solution used in manufacturing electrolytic copper foils and 2-layer flexible substrates and other printed wiring boards, and relates particularly to a copper electrolytic solution used in manufacturing electrolytic copper foils with excellent elongation and tensile strength that allow fine patterning and 2-layer flexible substrates.

BACKGROUND ART

An electrolytic copper foil is generally produced as follows. A rotating metal cathode drum with a polished surface is used along with an insoluble metal anode that surrounds said cathode drum and is disposed at a position substantially corresponding to the lower half of said cathode drum, a copper electrolytic solution is allowed to flow between the cathode drum and the anode, a potential differential is provided between these to electrodeposit copper onto the cathode drum, and the electrodeposited copper is peeled away from the cathode drum when it reaches a specific thickness, so that a copper foil is produced continuously.

A copper foil obtained in this way is generally called a raw foil and, after this, it is subjected to a number of surface treatments and used for printed wiring boards and so forth.

FIG. 1 is a simplified diagram of a conventional apparatus for producing a copper foil. This electrolytic copper foil production apparatus has a cathode drum 1 installed in an electrolysis bath containing an electrolytic solution. This cathode drum 1 is designed to rotate while being partially submerged (substantially the lower half) in the electrolytic solution.

An insoluble anode 2 is provided so as to surround the outer peripheral lower half of this cathode drum 1. A specific gap 3 is maintained between the cathode drum 1 and the anode 2, and an electrolytic solution is allowed to flow through this gap. Two anode plates are disposed in the apparatus shown in FIG. 1.

With the apparatus in FIG. 1, the electrolytic solution is supplied from below, and this electrolytic solution goes through the gap 3 between the cathode drum 1 and the anode 2, overflows from the top edge of the anode 2, and is then recirculated. A rectifier is interposed between the cathode drum 1 and the anode 2 so that a specific voltage can be maintained between the two components.

As the cathode drum 1 rotates, the thickness of the copper electrodeposited from the electrolytic solution increases. When at least a certain thickness is reached, this raw foil 4 is peeled away and continuously taken up. A raw foil produced in this manner is adjusted for thickness by varying the distance between the cathode drum 1 and the anode 2, the flow rate of the supplied electrolytic solution, or the amount of electricity supplied.

A copper foil produced with an electrolytic copper foil producing apparatus such as this has a mirror surface on the side touching the cathode drum, but the opposite side is a rough surface with bumps and pits. Problems encountered with ordinary electrolysis are that the bumps and pits on the rough side are severe, undercutting tends to occur during etching, and fine patterning is difficult.

On the one hand, as the density on printed wiring boards has steadily risen, there has more recently been a need for a copper foil that can be more finely patterned as the circuit width decreases and multilayer circuits are produced. This fine patterning requires a copper foil that has a good etching rate and uniform solubility, that is, a copper foil with excellent etching characteristics.

Meanwhile, the properties required of copper foils for printed wiring boards include not only elongation at room temperature but also elongation properties to prevent cracking due to temperature stress, as well as high tensile stress, to maintain the dimensional stability of the printed wiring board.

However, a copper foil with a highly irregular rough surface is wholly unsuited to fine patterning as described above. Ways are therefore being studied on lowering the profile of the rough surface. It is known that the profile can be lowered by adding large quantities of glue or thiourea to the electrolytic solution.

However, the problem with such additives is that they dramatically lower the elongation percentage, greatly detracting from the foil's properties as a copper foil for printed wiring boards.

2-layer flexible substrates have gained attention as substrates for preparing flexible wiring boards. Because in a 2-layer flexible substrate, a copper conductor layer is provided directly on an insulating film without an adhesive, the substrate itself can advantageously be kept thin and the thickness of the copper conductor layer can be adjusted at will before adhesion. The normal method of manufacturing such a 2-layer flexible substrate is to form an underlying metallic layer by dry plating on the insulating film, and then electroplating copper on top. However, the underlying metallic layer obtained in this way contains numerous pinholes, resulting in exposure of the insulating film and, in the case of a thin copper conductor layer, the areas exposed by the pinholes are not filled in and pinholes occur on the surface of the copper conductor layer, leading to wiring defects. As a means of solving this problem, Patent Document 1, for example, describes a 2-layer flexible substrate manufacturing method in which an underlying metallic layer is formed on an insulating film by a dry plating process, a primary electrolytic copper plating coating layer is formed on the underlying metallic layer and treated with an alkali solution, after which an electroless copper plating coating is adhered and, finally, a secondary electrolytic copper plating coating layer is formed. However, this method involves complex steps.

Patent Document 1: Japanese Patent Publication No. H10-193505

DISCLOSURE OF THE INVENTION

Problems that the Invention is to Solve

It is an object of the present invention to provide a low profile electrolytic copper foil with a low surface roughness at the rough surface side (opposite side from the glossy side) in the electrolytic copper foil manufacture using a cathode drums and, in particular, to provide an electrolytic copper foil with excellent elongation and tensile strength that allows fine patterning.

Another object is to provide a copper electrolytic solution capable of uniform copper plating without pinholes on a 2-layer flexible substrate.

Means for Solving the Problems

The inventors discovered that an electrolytic copper foil with excellent elongation and tensile strength that allows fine patterning and a 2-layer flexible substrate having a uniform copper plating without pinholes could be obtained by adding to the electrolytic solution an additive optimal for obtaining a low profile.

Based on this finding, the inventors perfected the present invention upon discovering that an electrolytic copper foil with excellent elongation and tensile strength that allows fine patterning can be obtained by electrolysis using a copper electrolytic solution containing a compound with a specific skeleton in an electrolytic copper foil manufacturing method in which a copper electrolytic solution is made to flow between a cathode drum and an anode to electrodeposit copper on the cathode drum, after which the electrodeposited copper foil is peeled from the cathode drum to manufacture a continuous copper foil. The inventors also discovered that in a method for manufacturing a 2-layer flexible substrate, a 2-layer flexible substrate having a uniform copper plating layer without pinholes could be obtained by first forming an underlying metal layer on an insulating film by dry plating using at least one selected from the group consisting of nickel, nickel alloy, chrome, cobalt, cobalt alloy, copper and copper alloy, and then plating using a copper electrolytic solution containing a compound having a specific skeleton.

That is, the present invention consists of the following.

(1) A copper electrolytic solution containing as an additive a compound having a specific skeleton represented by General Formula (1) below, which is obtained by an addition reaction in which water is added to a compound having in a molecule at least one epoxy group:

Chemical Formula 1

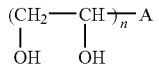

(1)

wherein A is an epoxy compound residue and n is an integer of 1 or more.

(2) The copper electrolytic solution according to (1) above, wherein the epoxy compound residue A of the aforementioned compound having a specific skeleton has a linear ether bond.

(3) A copper electrolytic solution according to (1) or (2) above, wherein the aforementioned compound having a specific skeleton includes any of the compounds represented by chemical formulae (2) through (9) below:

Chemical Formula 2

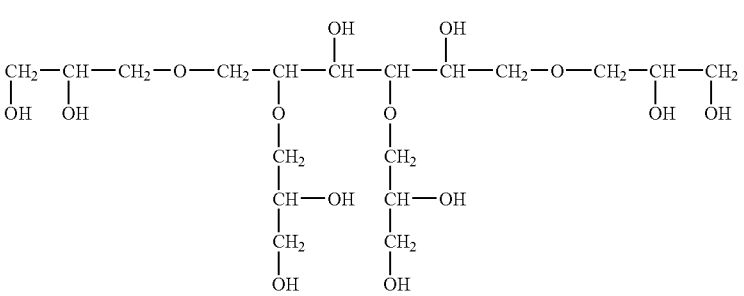

(2)

Chemical Formula 3

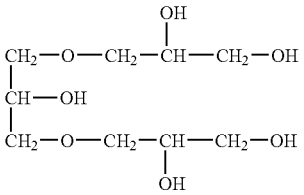

(3)

Chemical Formula 4

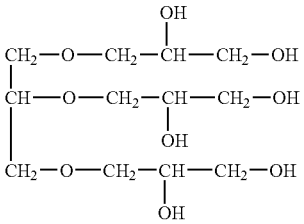

(4)

Chemical Formula 5

-continued

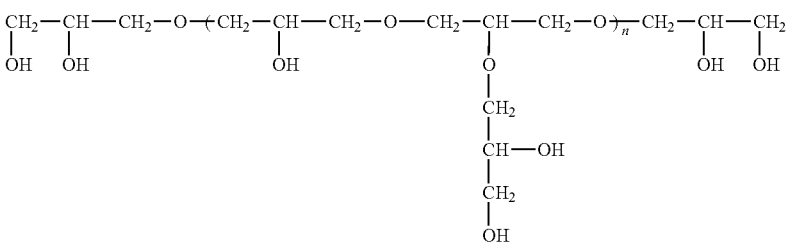

(5)

wherein n is an integer of 1 to 5.

Chemical Formula 6

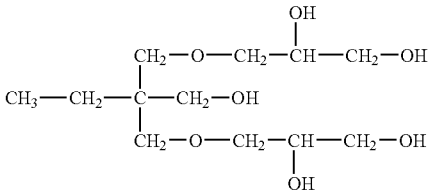

(6)

Chemical Formula 7

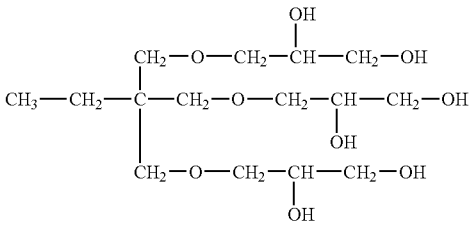

(7)

Chemical Formula 8

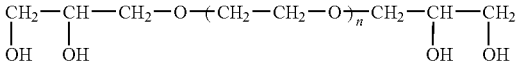

(8)

wherein n is an integer of 1 to 22.

Chemical Formula 9

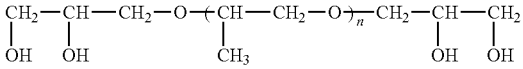

(9)

wherein n is an integer of 1 to 3.

(4) The copper electrolytic solution according to any one of (1) through (3) above, wherein the aforementioned copper electrolytic solution contains an organic sulfur compound.

(5) The copper electrolytic solution according to (4) above, wherein the aforementioned organic sulfur compound is a compound represented by General Formula (10) or (11) below:

$$X—R^1—(S)_n—R^2—Y \quad (10)$$

$$R^4—S—R^3—SO_3Z \quad (11)$$

wherein, in general formulae (10) and (11), $R^1$, $R^2$ and $R^3$ are alkylene groups with 1 through 8 carbon atoms, $R^4$ is selected from the group consisting of hydrogen and Chemical Formula 10

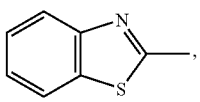

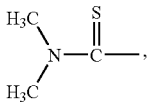

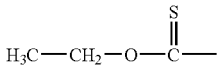

and

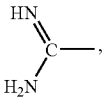

X is selected from the group consisting of hydrogen, a sulfonic acid group, a phosphonic acid group, and an alkali metal salt group or ammonium salt group of sulfonic acid or phosphonic acid, Y is selected from the group consisting of a sulfonic acid group, a phosphonic acid group, and an alkali metal salt group of sulfonic acid or phosphonic acid, Z indicates hydrogen or an alkali metal, and n is 2 or 3.

(6) An electrolytic copper foil manufactured using the copper electrolytic solution according to any one of (1) through (5) above.

(7) A copper clad laminate formed using the electrolytic copper foil according to (6) above.

(8) A printed wiring board manufactured using the copper electrolytic solution according to any one of (1) through (5) above.

(9) A printed wiring board wherein the printed wiring board according to (8) above is a 2-layer flexible substrate.

Effects of the Invention

The copper electrolytic solution of the present invention having a compound with a specific skeleton and also an organic sulfur compound added thereto is extremely effective for lowering the profile of the resulting electrolytic copper foil and 2-layer flexible substrate, effectively maintains elongation properties in the copper foil, and also provides a high tensile strength.

BEST MODE FOR CARRYING OUT THE INVENTION

In the present invention, it is vital that the compound with the specific skeleton represented by General Formula (1) above, which is obtained by an addition reaction in which water is added to a compound having in the molecule one or more epoxy groups, be present in the electrolytic solution.

The compound with the specific skeleton represented by General Formula (1) above is synthesized by the addition reaction represented by the following reaction formula. That is, it can be manufactured by mixing a compound having one or more epoxy groups in the molecule with water and reacting them for about 10 minutes through 48 hours at 50 through 100° C.:

Chemical Formula 11

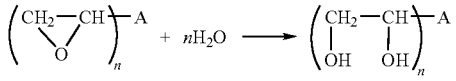

wherein A is an epoxy residue and n is an integer of 1 or more.

The compound having a specific skeleton is preferably a compound having a linear ether bond in epoxy compound residue A. A compound having one of the structural formulae (2) through (9) below is preferred as the compound having a linear ether bond in epoxy compound residue A, and in formulae (2) through (9) epoxy compound residue A is as follows:

Chemical Formula 12

(2)

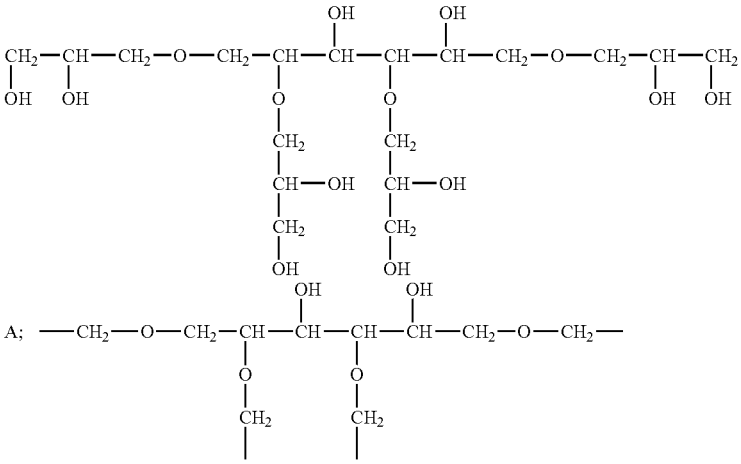

Chemical Formula 13

(3)

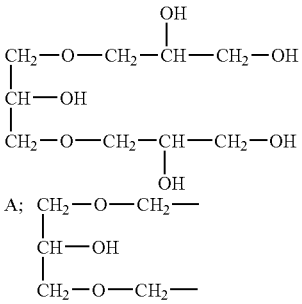

Chemical Formula 14

(4)

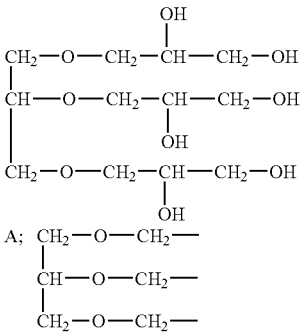

-continued

Chemical Formula 15

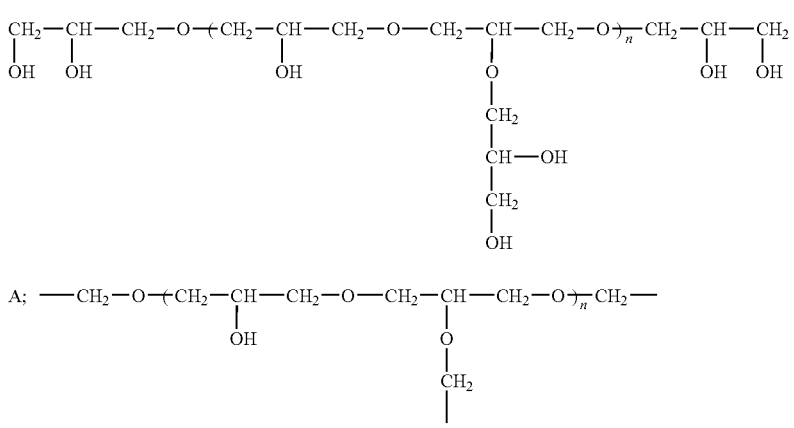

(5)

wherein n is an integer of 1 to 5.)

Chemical Formula 16

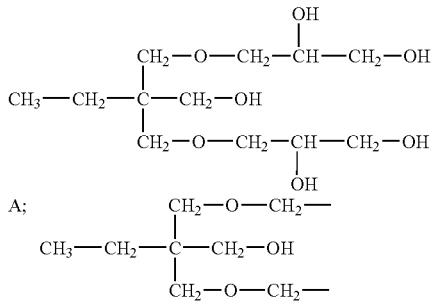

(6)

Chemical Formula 17

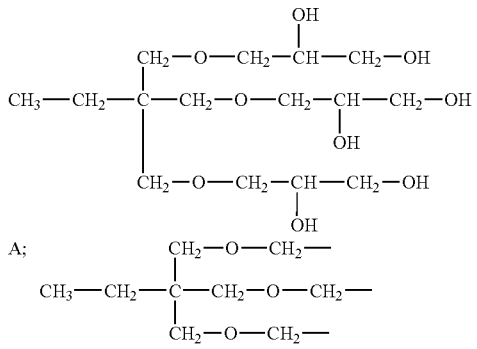

(7)

Chemical Formula 18

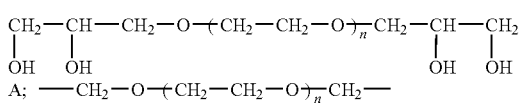

(8)

wherein n is an integer of 1 to 22.

Chemical Formula 19

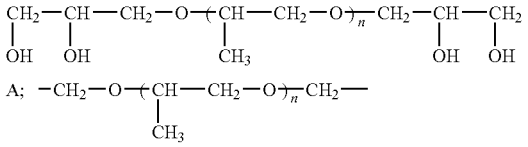

(9)

wherein n is an integer of 1 to 3.

An organic sulfur compound is preferably added to the aforementioned copper electrolytic solution. The organic sulfur compound is preferably a compound having as its structural formula General Formula (10) or (11) above.

The following are examples of the organic sulfur compound represented by General Formula (10) above, and can be used by preference.

$H_2O_3P—(CH_2)_3—S—S—(CH_2)_3—PO_3H_2$ $HO_3S—(CH_2)_4—S—S—(CH_2)_4—SO_3H$ $NaO_3S—(CH_2)_3—S—S—(CH_2)_3—SO_3Na$ $HO_3S—(CH_2)_2—S—S—(CH_2)_2—SO_3H$ $CH_3—S—S—CH_2—SO_3H$ $NaO_3S—(CH_2)_3—S—S—S—(CH_2)_3—SO_3Na$ $(CH_3)_2CH—S—S—(CH_2)_2—SO_3H$

The following are examples of the organic sulfur compound represented by General Formula (11) above, and can be used by preference.

Chemical Formula 20

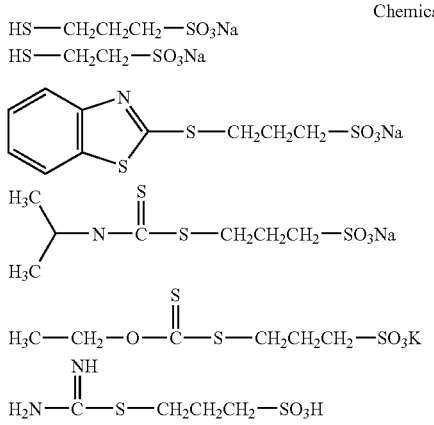

The ratio of the aforementioned compound having a specific skeleton to the organic sulfur compound in the copper electrolytic solution is preferably between 1:50 and 100:1 or, more preferably, between 1:10 and 50:1 by weight. The concentration of the compound having a specific skeleton in the copper electrolytic solution is preferably 1 through 1000 ppm or, more preferably, 1 through 200 ppm.

The copper electrolytic solution of the present invention can contain as additives those used in ordinary acidic copper electrolytic solutions in addition to the aforementioned compound having a specific skeleton and organic sulfur compound, and known additives such as polyethylene glycol, polypropylene glycol and other polyether compounds, polyethylenimine, phenazine dye, glue, cellulose and the like can be added.

For the plating conditions, a plating temperature of 50 through 65° C. and a current density of 40 through 150 A/dm$^2$ is preferred for copper foil manufacture while, in the case of a 2-layer flexible substrate, a plating temperature of 25 through 60° C. and a current density of 1 through 50 A/cm$^2$ is preferred.

A copper clad laminate obtained by laminating the electrolytic copper foil of the present invention is a copper clad laminate with excellent elongation and tensile strength.

EXAMPLES

The present invention is explained in more detail below using examples.

Synthesis Example 1 of a Compound Having a Specific Skeleton 10.0 g (epoxy groups 0.0544 mol) of the epoxy compound represented by the following chemical formula (Denacol EX-521, manufactured by Nagase Chemitex Corp.) and 40.0 g of pure water were placed in a triangular flask and reacted for 24 hours at 85° C. using a cooling tube having dry ice-methanol as the cooling medium, to obtain the following compound (compound of Formula (5) above, n=3).

Chemical Formula 21

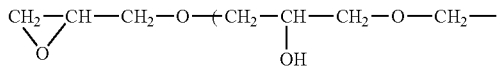

-continued

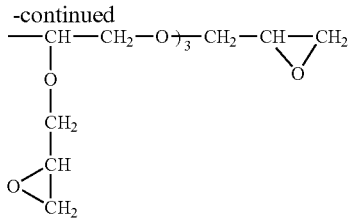

Chemical Formula 22

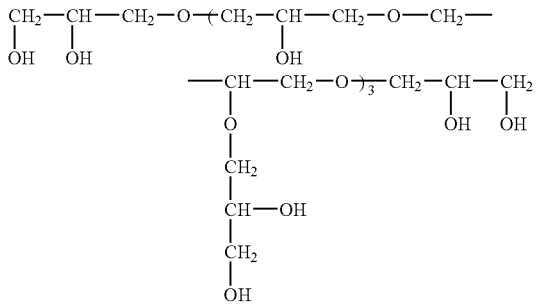

The $^{13}$C-NMR spectrum of the resulting compound is shown in FIG. 2. The $^{13}$C-NMR spectrum of the raw material epoxy resin (Denacol EX-521, manufactured by Nagase Chemitex Corp.) is also shown for comparison in FIG. 3. As clear from FIGS. 2 and 3, peaks at 52 ppm and 45 ppm attributed to the epoxy groups disappeared from the resulting compound and this indicates the cleavage of the epoxy groups.

Synthesis Examples 2 Through 6 of Compounds Having specific skeletons

The following compounds having specific skeletons were synthesized as in Synthesis Example 1 except that the following compounds were used in place of the epoxy resin (Denacol EX-521, manufactured by Nagase Chemitex Corp.) used in Synthesis Example 1 of a compound having a specific skeleton.

Synthesis Example 2

Compound of Formula (5) above (n=1) (raw material epoxy resin: Decanol EX-421, manufactured by Nagase Chemitex Corp.)

Synthesis Example 3

Compound of Formula (2) above (raw material epoxy resin: Decanol EX-614B, manufactured by Nagase Chemitex Corp.)

Synthesis Example 4

Compound of Formula (8) above (n≅13) (raw material epoxy resin: Decanol EX-841, manufactured by Nagase Chemitex Corp.)

Synthesis Example 5

Mixture of compounds of Formulae (3) and (4) above (raw material epoxy resin: Decanol EX-313, manufactured by Nagase Chemitex Corp.)

Synthesis Example 6

Compound of Formula (9) above (n≅3) (raw material epoxy resin: Decanol EX-920, manufactured by Nagase Chemitex Corp.)

Examples 1 Through 13 and Comparative Examples 1 and 2

35 μm electrolytic copper foils were manufactured at a current density of 90 A/dm$^2$ using the electrolytic copper foil manufacturing device shown in FIG. 1. The compositions of the electrolytic solutions were as follows, with the additives added in the amounts shown in Table 1.

Cu: 90 g/L $H_2SO_4$: 80 g/L

Cl: 60 ppm

Liquid temperature: 55 through 57° C.

Additive A: bis(3-sulphopropyl)disulfide disodium salt (SPS, manufactured by Raschig)

Additive B: 3-mercapto-1-propanesulfonate sodium salt (Raschig Mps)

Additive C: Compounds having specific skeletons obtained in aforementioned synthesis examples C1: Compound of Synthesis Example 1

C2: Compound of Synthesis Example 2

C3: Compound of Synthesis Example 3

C4: Compound of Synthesis Example 4

C5: Compound of Synthesis Example 5

C6: Compound of Synthesis Example 6

The surface roughness Rz (μm) of the resulting electrolytic copper foils was measured in accordance with JIS B 0601 and the elongation (%) at room temperature and the tensile strength (kgf/mm$^2$) at room temperature in accordance with IPC-TM650. The results are shown in Table 1.

As shown in Table 1 above, in Examples 1 through 13 in which a compound having a specific skeleton was added, the surface roughness Rz was in the range of 1.55 through 2.20 μm while the elongation at room temperature was 5.10 through 6.20% and the tensile strength at room temperature was 51.5 through 72.0 kgf/mm$^2$. Thus, despite the dramatic low profile achieved in these examples, the elongation at room temperature and tensile strength at room temperature were equal to or greater than those achieved in Comparative Example 1, in which the compound having a specific skeleton of the present invention was not added. By contrast, a low profile was not achieved in Comparative Examples 1 and 2 in which the compound having a specific skeleton of the present invention was not added.

Examples 14 Through 19 and Comparative Examples 3 and 4

Polyimide films were electroplated under the following plating conditions to have roughly a 9 μm thick copper coating. The additives were added in the amounts shown in Table 2.

Liquid content: About 800 ml

Anode: Lead electrode

Cathode: Rotating electrode wrapped in polyimide film

Polyimide film: 37.5 μm thick Kapton E, manufactured by Dupont, coated with 10 nm NiCr+2000 Å Cu by sputtering Plating temperature: 50° C.

Current time: 1220 As

Current density: changing of 5→10→20→30 Å/dm$^2$

Flow velocity: 190 r.p.m.

Cu: 70 g/L $H_2SO_4$: 60 g/L

Cl: 75 ppm

TABLE 1

| | Additives (ppm) | | | | | | | | | Room temp. elongation | Room temp. tensile strength |
|---|---|---|---|---|---|---|---|---|---|---|---|
| | | | C | | | | | | | | |
| | A | B | C1 | C2 | C3 | C4 | C5 | C6 | Rz (μm) | (%) | (kgf/mm$^2$) |
| Example 1 | 50 | 0 | 50 | 0 | 0 | 0 | 0 | 0 | 1.70 | 6.20 | 58.1 |
| Example 2 | 50 | 0 | 0 | 50 | 0 | 0 | 0 | 0 | 1.68 | 5.40 | 55.5 |
| Example 3 | 50 | 0 | 0 | 0 | 50 | 0 | 0 | 0 | 1.55 | 6.11 | 59.2 |
| Example 4 | 50 | 0 | 0 | 0 | 0 | 50 | 0 | 0 | 1.72 | 5.50 | 62.0 |
| Example 5 | 50 | 0 | 0 | 0 | 0 | 0 | 50 | 0 | 1.85 | 5.20 | 52.0 |
| Example 6 | 50 | 0 | 0 | 0 | 0 | 0 | 0 | 50 | 1.95 | 6.03 | 58.6 |
| Example 7 | 0 | 50 | 50 | 0 | 00 | 0 | 0 | 0 | 1.68 | 6.10 | 57.5 |
| Example 8 | 0 | 50 | 0 | 50 | 0 | 0 | 0 | 0 | 1.65 | 5.52 | 55.5 |
| Example 9 | 0 | 50 | 0 | 0 | 50 | 0 | 0 | 0 | 1.58 | 6.10 | 61.0 |
| Example 10 | 0 | 50 | 0 | 0 | 0 | 50 | 0 | 0 | 1.90 | 5.35 | 62.5 |
| Example 11 | 0 | 50 | 0 | 0 | 0 | 0 | 50 | 0 | 1.80 | 5.25 | 51.5 |
| Example 12 | 0 | 50 | 0 | 0 | 0 | 0 | 0 | 50 | 1.92 | 6.13 | 59.2 |
| Example 13 | 0 | 0 | 50 | 0 | 0 | 0 | 0 | 0 | 2.20 | 5.10 | 72.0 |
| Comparative Example 1 | 0 | 0 | 0 | 0 | 0 | 0 | 0 | 0 | 5.80 | 8.90 | 37.9 |
| Comparative Example 2 | 100 | 0 | 0 | 0 | 0 | 0 | 0 | 0 | 5.30 | 0.21 | 10.3 |

Additive A: bis(3-sulphopropyl)disulfide disodium salt (Raschig Sps)

Additive C: Compounds having specific skeletons obtained in aforementioned synthesis examples C1: Compound of Synthesis Example 1

C2: Compound of Synthesis Example 2

C3: Compound of Synthesis Example 3

C4: Compound of Synthesis Example 4

C5: Compound of Synthesis Example 5

C6: Compound of Synthesis Example 6

The surface roughness Rz (μm) (10-point average roughness) and surface roughness Ra (μm) (arithmetic average roughness) of each of the obtained 2-layer flexible substrates were measured in accordance with JIS B 0601. The plating surface was also observed for plating defects by optical microscopy and SEM. The results are shown in Table 2.

TABLE 2

| | Additive | Additive C (ppm) | | | | | | Rz | | | Ra |
|---|---|---|---|---|---|---|---|---|---|---|---|
| | (ppm) A | C1 | C2 | C3 | C4 | C5 | C6 | (μm) | Defects | Appearance | (μm) |
| Example 14 | 50 | 50 | 0 | 0 | 0 | 0 | 0 | 1.78 | no | semi-gloss | 0.19 |
| Example 15 | 50 | 0 | 50 | 0 | 0 | 0 | 0 | 1.69 | no | semi-gloss | 0.17 |
| Example 16 | 50 | 0 | 0 | 50 | 0 | 0 | 0 | 2.18 | no | semi-gloss | 0.31 |
| Example 17 | 50 | 0 | 0 | 0 | 50 | 0 | 0 | 1.73 | no | semi-gloss | 0.19 |
| Example 18 | 50 | 0 | 0 | 0 | 0 | 50 | 0 | 1.80 | no | semi-gloss | 0.20 |
| Example 19 | 50 | 0 | 0 | 0 | 0 | 0 | 50 | 1.63 | no | semi-gloss | 0.15 |
| Comparative Example 3 | 50 | 0 | 0 | 0 | 0 | 0 | 0 | 6.63 | yes | no gloss | 1.02 |
| Comparative Example 4 | 0 | 0 | 0 | 0 | 0 | 0 | 0 | 7.32 | yes | no gloss | 1.10 |

As shown in Table 2, Examples 14 through 19 in which the compound having a skeleton structure of the present invention was added all exhibited semi-gloss, with surface roughness Rz in the range of 1.63 through 2.18 μm and Ra in the range of 0.15 to 0.31 μm and no defects, and thus appeared suited to fine patterning.

EXPLANATION OF REFERENCE NUMERALS

1: cathode drum

2: anode

3: gap

4: raw foil

Figure 1:
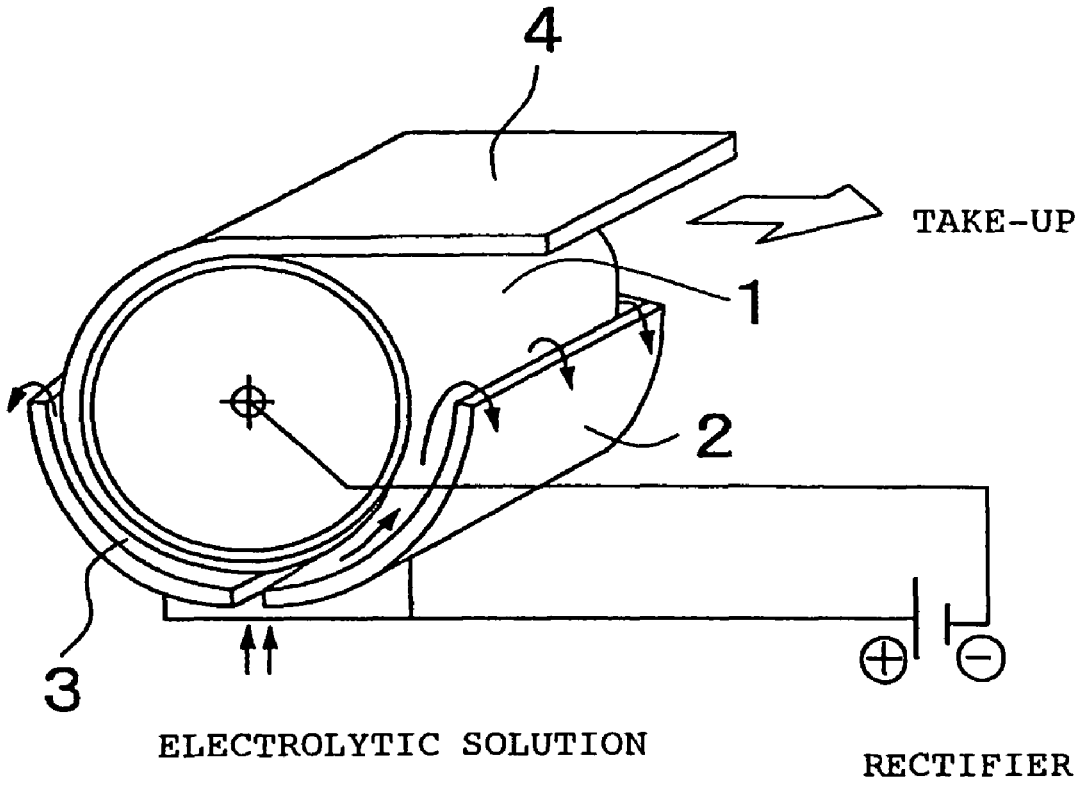
FIG. 1 (PRIOR ART)
FIG. 1 shows one example of an electrolytic copper foil manufacturing device.
Figure 2:
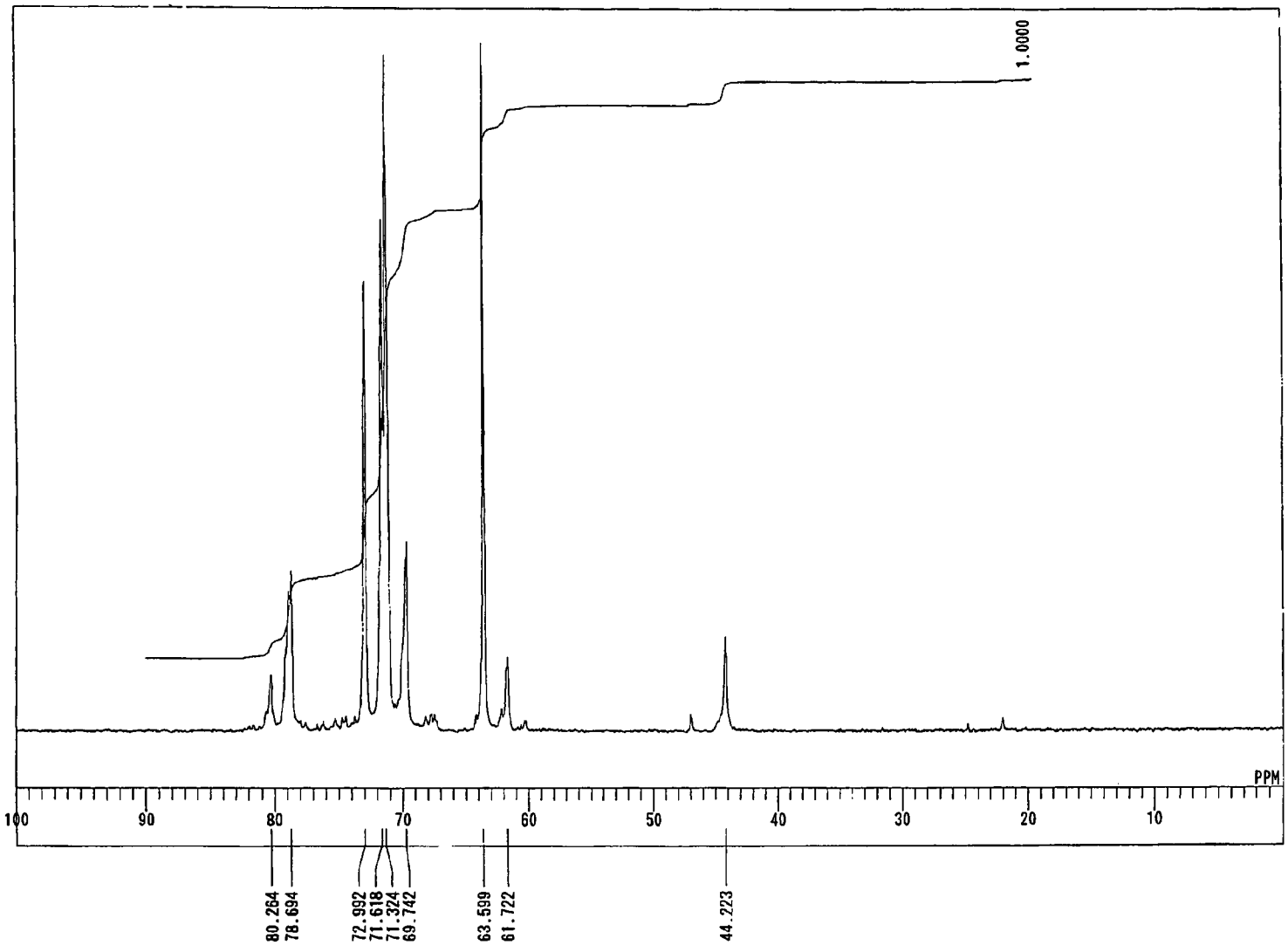
FIG. 2 shows the $^{13}$C-NMR spectrum of a compound obtained in Synthesis Example 1 of a compound having a specific skeleton.
Figure 3:
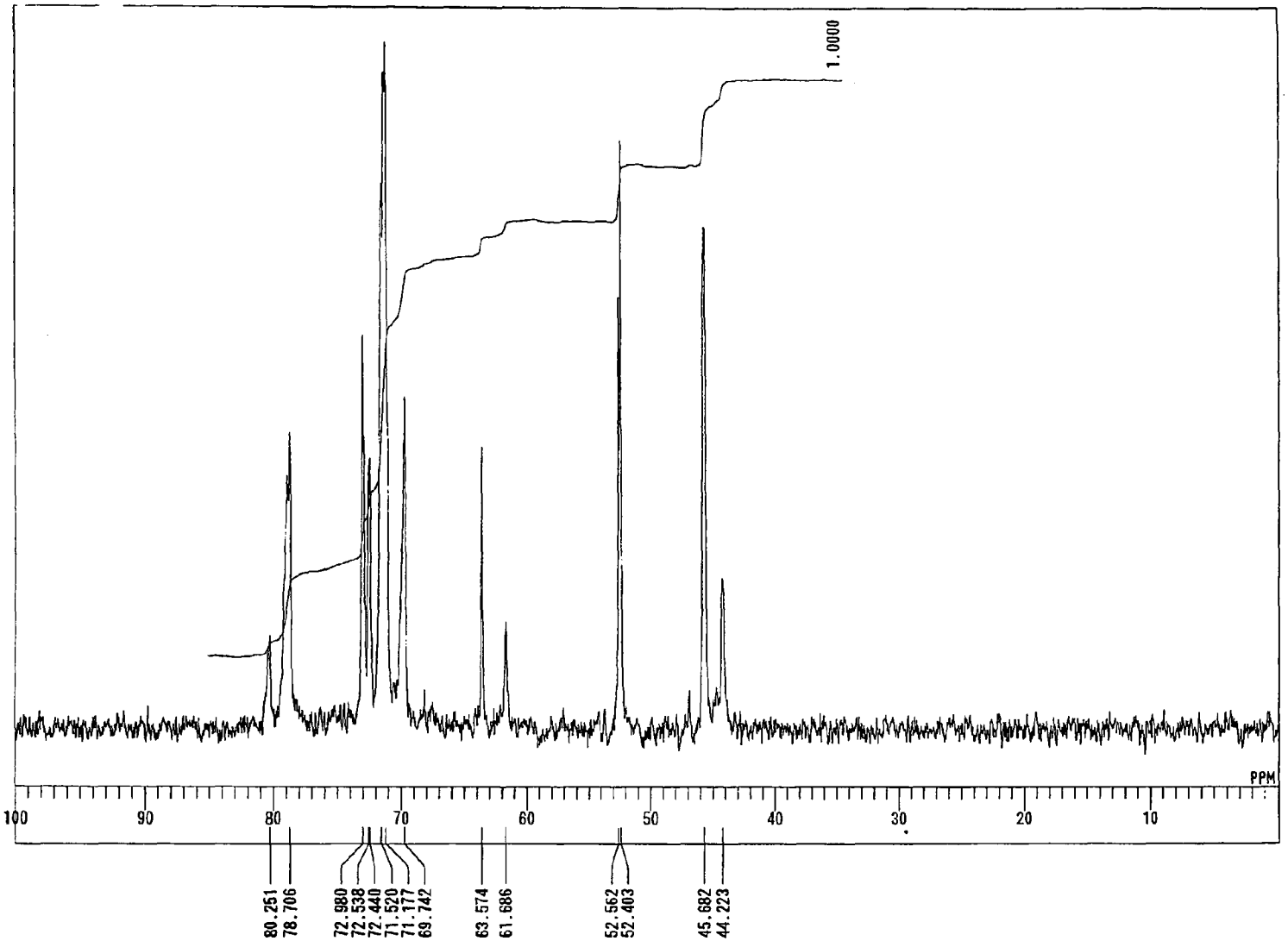
FIG. 3 shows the $^{13}$C-NMR spectrum of the epoxy compound (Decanol EX-521, manufactured by Nagase Chemitex Corp.) used in Synthesis Example 1 of a compound having a specific skeleton.

The invention claimed is:

1. A copper electrolytic solution containing copper and an additive selected from the group consisting of at least one compound represented by chemical formulae (2) through (9) below, which is obtained by an addition reaction in which water is added to a compound having in a molecule at least one epoxy group:

(2)

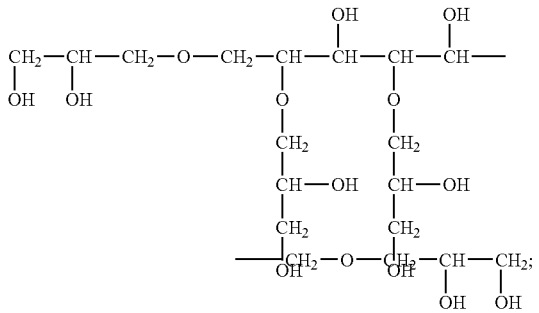

(3)

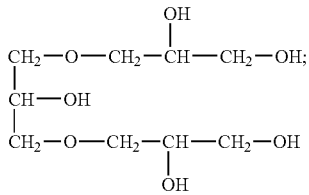

-continued (4)

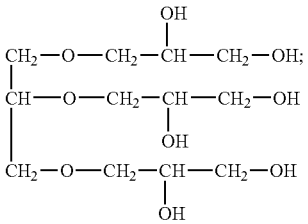

(5)

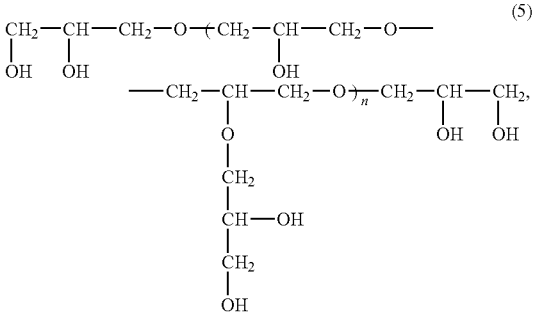

wherein n is an integer of 1 to 5;

(6)

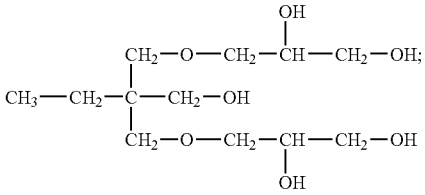

(7)

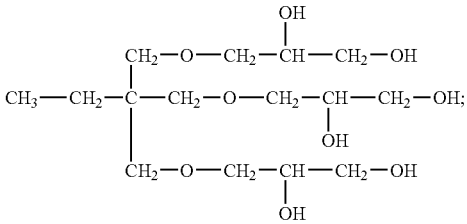

(8)

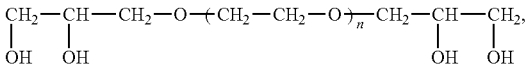

wherein $n_1$ is an integer of 1 to 22; and (9)

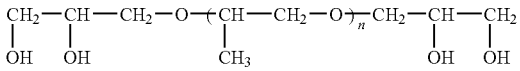

wherein $n_2$ is an integer of 1 to 3.

2. A copper electrolytic solution according to claim 1, wherein said copper electrolytic solution further contains an organic sulfur compound.

3. The copper electrolytic solution according to claim 2, wherein said organic sulfur compound is selected from the group consisting of compounds represented by formula (10) and (11) below:

$$X—R^1—(S)_n—R^2—Y \quad (10)$$

$$R^4—S—R^3—SO_3Z \quad (11)$$

wherein in formulae (10) and (11), $R^1$, $R^2$ and $R^3$ are alkylene groups with 1 through 8 carbon atoms, $R^4$ is selected from the group consisting of hydrogen,

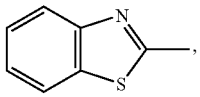

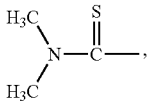

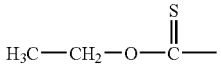

and

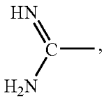

X is selected from the group consisting of hydrogen, a sulfonic acid group, a phosphonic acid group, an alkali metal salt group and an ammonium salt group of an acid selected from the group consisting of sulfonic acid and phosphonic acid, Y is selected from the group consisting of a sulfonic acid group, a phosphonic acid group and an alkali metal salt group of an acid selected from the group consisting of sulfonic acid and phosphonic acid, Z is hydrogen or an alkali metal, and n is 2 or 3.

* * * * *